US007079170B2

(12) United States Patent
Taira et al.

(10) Patent No.: US 7,079,170 B2
(45) Date of Patent: Jul. 18, 2006

(54) METHOD OF CORRECTING THE LIGHT AMOUNT OF A PRINTHEAD

(75) Inventors: Yoshihiko Taira, Kanagawa (JP); Yukihiro Matsushita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/718,697

(22) Filed: Nov. 24, 2003

(65) Prior Publication Data

US 2004/0100552 A1 May 27, 2004

(30) Foreign Application Priority Data

Nov. 26, 2002 (JP) ..... 2002-341829

(51) Int. Cl.
*B41J 2/45* (2006.01)
*B41J 2/385* (2006.01)

(52) U.S. Cl. ..... 347/238; 347/130

(58) Field of Classification Search ..... 347/130–133, 347/143–144, 236–238, 246–250, 251–254; 702/90
See application file for complete search history.

(56) References Cited

U.S. PATENT DOCUMENTS 5,586,055 A * 12/1996 Ng et al. ..... 702/90
6,064,418 A * 5/2000 Shimizu et al. ..... 347/238
2004/0008247 A1* 1/2004 Masuda ..... 347/238

FOREIGN PATENT DOCUMENTS

JP 08118722 A * 5/1996
JP A 2001-80111 3/2001

* cited by examiner

*Primary Examiner*—Hai Pham
(74) *Attorney, Agent, or Firm*—Oliff & Berridge, PLC

(57) ABSTRACT

The method of the invention includes: determining the beam profiles of plural LED elements (light-emitting elements) including joints of LED chips (light-emitting chips); determining the distance between the LED elements at the joints of the LED chips from the distance between peaks of the beam profiles; comparing the determined distance between the LED elements with the resolution pitch of the printhead; raising the light amount of the LED elements of at least one side of the joints of the LED chips when the determined distance between the LED elements is longer than the resolution pitch; and lowering the light amount of the LED elements of at least one side of the joints of the LED chips when the distance between the LED chips is shorter than the resolution pitch.

4 Claims, 5 Drawing Sheets

METHOD OF CORRECTING THE LIGHT AMOUNT OF A PRINTHEAD

BACKGROUND OF THE INVENTION

1. Field of the Invention

The present invention relates to a method of correcting the light amount of a printhead where plural light-emitting chips, in which plural light-emitting elements are disposed in a row, are disposed in a row.

2. Description of the Related Art

Conventionally, in an electrophotographic printer, a photosensitive drum whose surface has been uniformly and evenly charged is exposed to form an electrostatic latent image, the electrostatic latent image is developed into a toner image, and the toner image is transferred and fixed to a printed medium. Incidentally, in a case where the photosensitive drum is exposed, an electrophotographic printer that uses an LED printhead using LEDS as light-emitting elements has been proposed because the photosensitive drum can be activated at a high speed and is compact.

Here, description will be given of an LED printhead 7 using FIG. 6. As shown in the drawing, plural LED elements 3 are arranged in a row on LED chips 1. The LED chips 1 are disposed in a row on a substrate 5.

The pitch at which the LED elements 3 are disposed is set to a value that is the same as the resolution pitch at which the LED printhead is disposed.

However, in this LED printhead 7, whereas the pitch (P) of the LED elements 3 inside the LED chips 1 can be manufactured with high precision, the precision of the pitch (P') of LED elements 3' at joints 9 of the LED chips 1 is poor due to problems in terms of facilities. For example, whereas the tolerance of the pitch (P) of the LED chips 3 inside the LED chips 1 is ±1 μm, the tolerance of the pitch (P') of the LED elements 3' at the joints 9 of the LED chips 1 is ±10 μm. Thus, in many cases, P is less than P', and there are many cases where white stripes occur.

Thus, it has been proposed to prevent the occurrence of white stripes by making the pitch (P) of the LED elements 3 inside the LED chips 1 narrower than the pitch P' of the LED elements 3' at the joints 9 of the LED chips 1.

However, this proposal does nothing more than lower the frequency with which white stripes occur and cannot completely eliminate the occurrence of white stripes.

Thus, it has been proposed to raise the light amount of the LED elements 3' at the joints 9 of the LED chips 1 by uniformly increasing the current supplied to the LED elements 3' at the joints 9 of the LED chips 1 to be 2 to 6% more than the current supplied to the other LED elements 3.

It has also been proposed to increase the current supplied to the LED elements 3' at the joints 9 of the LED chips 1 to be more than the current supplied to the other LED elements 3 as long as the pitch of the joints of the LED chips is equal to or greater than a predetermined value. For example, it has been proposed to increase the current supplied to the LED elements 3' at the joints 9 of the LED chips 1 to be 2% more than the current supplied to the other LED elements 3 and to raise the light amount of the LED elements 3' at the joints 9 of the LED chips 1 in a case where the pitch (P') of the LED elements 3' at the joints 9 of the LED chips 1 is 66 μm or greater and less than 69 μm, and to increase the current supplied to the LED elements 3' at the joints 9 of the LED chips 1 to be 4% more than the current supplied to the other LED elements 3 and to raise the light amount of the LED elements 3' at the joints 9 of the LED chips 1 in a case where the pitch (P') is 69 μm or greater (e.g., see JP-A-2001-80111).

However, there are the following problems in the method where the light amount of the LED elements 3' at the joints 9 of the LED chips 1 is raised by uniformly increasing the current supplied to the LED elements 3' at the joints 9 of the LED chips 1 to be more than the current supplied to the other LED elements 3.

Because the tolerance of the pitch (P') of the LED elements 3' at the joints 9 of the LED chips 1 is ±10 μm whereas the tolerance of the pitch (P) of the LED elements 3 inside the LED chips 1 is ±1 μm, it is not always the case that white stripes occur but there are also cases where black stripes occur. Thus, when the light amount of the LED elements 3' at the joints 9 of the LED chips 1 is raised by increasing the current supplied to the LED elements 3' at the joints 9 of the LED chips 1 to be more than the current supplied to the other LED elements 3, there are also cases where the black stripes are accentuated.

Also in the method of raising the light amount of the LED elements 3' at the joints 9 of the LED chips 1 by uniformly increasing the current supplied to the LED elements 3' at the joints 9 of the LED chips 1 to be more than the current supplied to the other LED elements 3 as long as the pitch of the joints of the LED chips 1 is equal to or greater than a predetermined value, consideration is only given to the pitch of the joints of the LED chips 1 and not to the profiles of the beams emitted from the LED elements 3. Thus, in a case where the beam profiles of the LED elements 3' at the joints 9 of the LED chips 1 greatly differ from those of the other LED elements, there are the problems that correction cannot be conducted well and white stripes and black stripes occur. Also, because the current supplied to the LED elements 3' is only altered at the two stages of 2% and 4%, the correction resolution is great. Thus, there is also the problem that white stripes and black stripes occur depending on the printing pattern.

SUMMARY OF THE INVENTION

The present invention has been devised in light of the aforementioned problems, and it is an object thereof to provide a method of correcting the light amount of a printhead in which white stripes and black stripes do not occur.

A first aspect of the invention for solving the aforementioned problems is a method of correcting the light amount of a printhead where plural light-emitting chips, in which plural light-emitting elements are formed in a row, are disposed in a row, the method including: determining the beam profiles of the plural light-emitting elements including joints of the light-emitting chips; determining the distance between the light-emitting elements at the joints of the light-emitting chips from the distance between peaks of the beam profiles; comparing the determined distance between the light-emitting elements with the resolution pitch of the light-emitting printhead; raising the light amount of the light-emitting elements of at least one side of the joints of the light-emitting chips when the determined distance between the light-emitting elements is longer than the resolution pitch; and lowering the light amount of the light-emitting elements of at least one side of the joints of the light-emitting chips when the distance between the light-emitting chips is shorter than the resolution pitch.

By using the beam profiles of the plural light-emitting elements including the joints of the light-emitting chips, correction that is more precise in comparison with a case where correction is conducted with the pitch of the joints of the light-emitting chips can be conducted.

Also, by determining the distance between the light-emitting elements at the joints of the light-emitting chips from the distance between peaks of the beam profiles, comparing the determined distance between the light-emitting elements with the resolution pitch of the light-emitting printhead, raising the light amount of the light-emitting elements of at least one side of the joints of the light-emitting chips when the determined distance between the light-emitting elements is longer than the resolution pitch, and lowering the light amount of the light-emitting elements of at least one side of the joints of the light-emitting chips when the distance between the light-emitting chips is shorter than the resolution pitch, more precise correction can be conducted because correction is conducted in accordance with the actual pitch of the plural light-emitting elements including the joints of the light-emitting chips in comparison to correction where the current supplied to the light-emitting elements at the joints of the light-emitting chips is uniformly increased to be more than the current supplied to the other light-emitting elements.

A second aspect of the invention is a method of correcting the light amount of a printhead where plural light-emitting chips, in which plural light-emitting elements are formed in a row, are disposed in a row, the method including: determining the beam profiles of the plural light-emitting elements including joints of the light-emitting chips; slicing the beam profiles at a predetermined level and determining the distance between the light-emitting elements at the joints of the light-emitting chips from the distance between median points of the sliced plane; comparing the determined distance between the light-emitting elements with the resolution pitch of the light-emitting printhead; raising the light amount of the light-emitting elements of at least one side of the joints of the light-emitting chips when the determined distance between the light-emitting elements is longer than the resolution pitch; and lowering the light amount of the light-emitting elements of at least one side of the joints of the light-emitting chips when the distance between the light-emitting chips is shorter than the resolution pitch.

By using the beam profiles of the plural light-emitting elements including the joints of the light-emitting chips, correction that is more precise in comparison with a case where correction is conducted with the pitch of the joints of the light-emitting chips can be conducted.

Also, by slicing the beam profiles at a predetermined level and determining the distance between the light-emitting elements at the joints of the light-emitting chips from the distance between median points of the sliced plane, comparing the determined distance between the light-emitting elements with the resolution pitch of the light-emitting printhead, raising the light amount of the light-emitting elements of at least one side of the joints of the light-emitting chips when the determined distance between the light-emitting elements is longer than the resolution pitch, and lowering the light amount of the light-emitting elements of at least one side of the joints of the light-emitting chips when the distance between the light-emitting chips is shorter than the resolution pitch, more precise correction can be conducted because correction is conducted in accordance with the actual pitch of the plural light-emitting elements including the joints of the light-emitting chips in comparison to correction where the current supplied to the light-emitting elements at the joints of the light-emitting chips is uniformly increased to be more than the current supplied to the other light-emitting elements.

A third aspect of the invention is the method of correcting the light amount of a printhead of the first aspect or the second aspect, wherein when the determined distance between the light-emitting elements is represented as d2 (μm), the resolution pitch is represented as d1 (μm) and the change in the light amount of the light-emitting elements whose light amount is raised and lowered is represented as P (%), d2−d1=P.

Because d2−d1=P when the determined distance between the light-emitting elements is represented as d2 (μm), the resolution pitch is represented as b1 (μm) and the change in the light amount of the light-emitting elements whose light amount is raised and lowered is represented as P (%), the correction resolution can be made small and white stripes and black stripes do not occur regardless of the printing pattern.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Next, an example of an embodiment of the invention will be described using the drawings. In the example of the present embodiment, description will be given using an LED printhead using LED elements as light-emitting elements.

Figure 2:
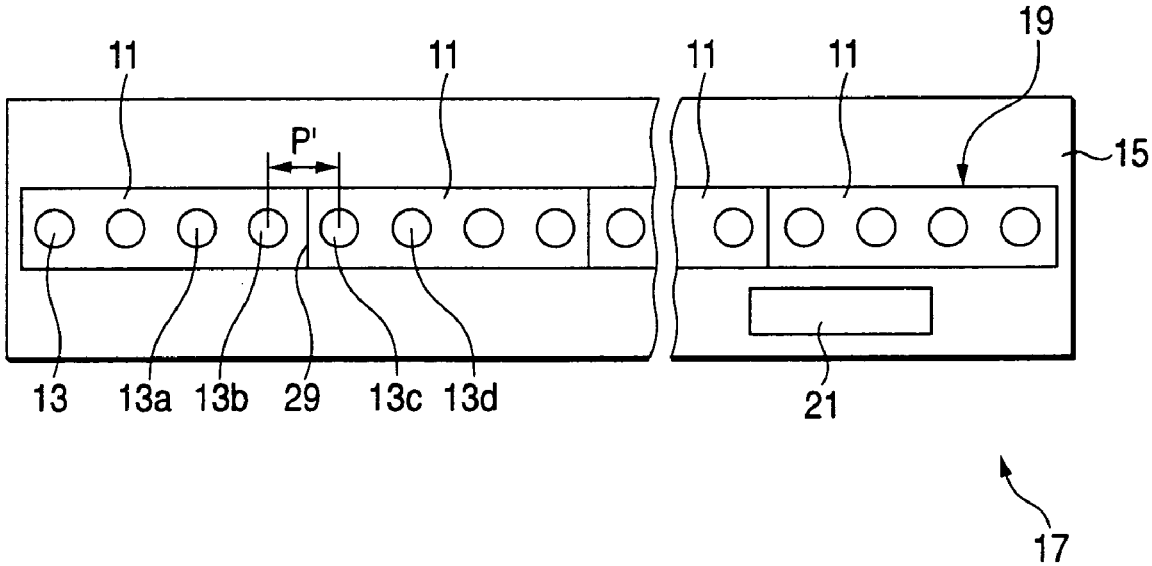
FIG. 2 is a diagram showing the configuration of an LED printhead of an example of an embodiment.

First, the configuration of an LED printhead 17 of the example of the present embodiment will be described using FIG. 2. As shown in the drawing, plural LED elements 13 are arranged in a row on LED chips 11. Additionally, the LED chips 11 are disposed in a row on a substrate 15 to form an LED array portion 19.

Moreover, a control portion 25, a drive circuit 23 and an EEPROM (Electronically Erasable Programmable Read-Only Memory: a ROM where the rewriting of data is possible) 21, which will be described later, are disposed on the substrate 15.

Figure 3:
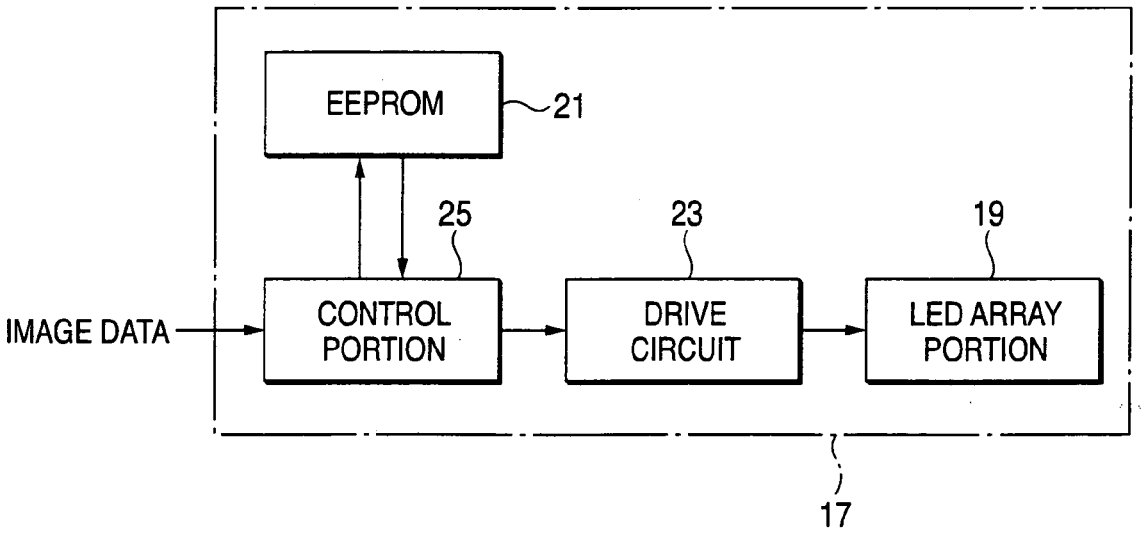
FIG. 3 is a block diagram describing the electrical configuration of the LED printhead of FIG. 2.

Next, the electrical configuration of the LED printhead 17 of the above-described configuration will be described using FIG. 3. The drive circuit 23 serves as drive means for driving the LED elements 13 of the LED array portion 19. The control portion 25 imports image data and references correction values of the EEPROM 21, which serves as a table in which are recorded correction values when the LED elements 13 are driven, to control the drive circuit.

Figure 1:
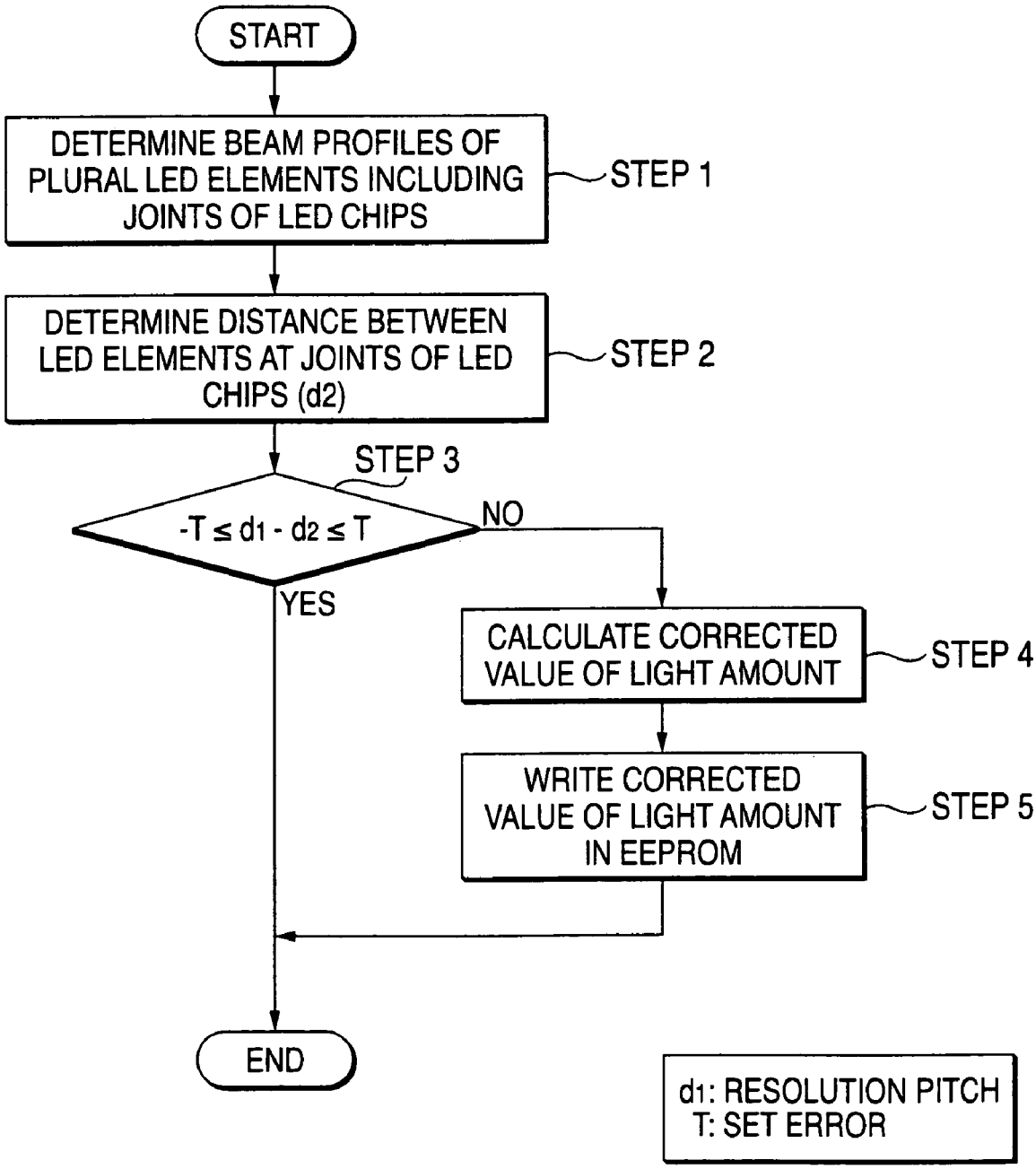
FIG. 1 is a flow chart describing a method of correcting the light amount of an LED printhead.

Next, a method of correcting the light amount of the LED printhead of this configuration will be described using FIG. 1.

First, the beam profiles of the plural LED elements 13 including joints of the LED chips 11 are determined (Step 1). For example, as shown in FIG. 2, the LED elements 13 including a joint 29 will be designated as LED element 13*a*, LED element 13*b*, LED element 13*c* and LED element 13*d*. The beam profiles of these LED elements 13 are shown in FIG. 4.

Then, the distance (d2 (μm)) between the LED elements at the joints of the LED chips 11 is determined from the beam profiles of the LED elements 13 including the joints of the LED chips 11 (Step 2).

Figure 4:
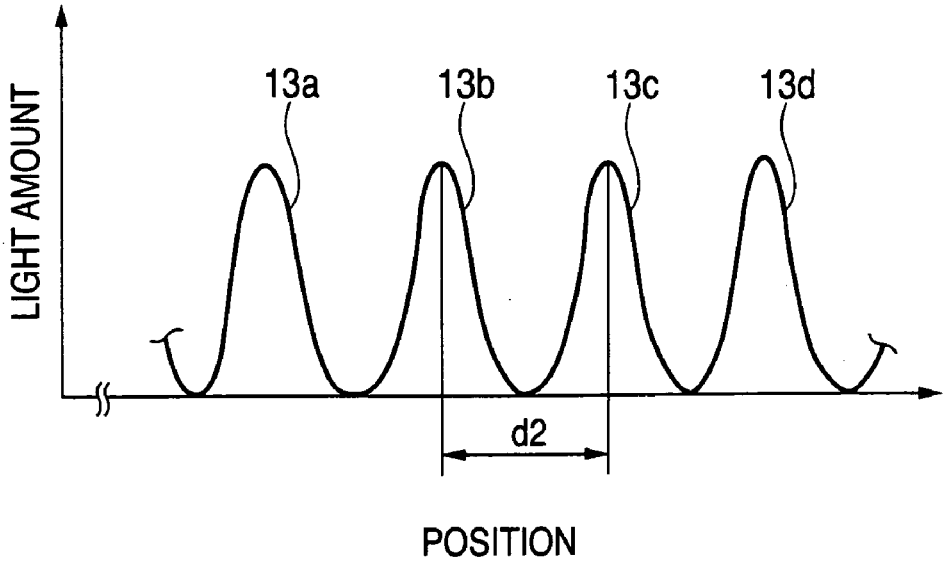
FIG. 4 is a graph showing an example of beam profiles in Step 1 of FIG. 1.

In the example of the present embodiment, the distance (d2) between the LED elements 13 at the joints of the LED chips 11 is determined from the distance between the peaks of the beam profiles as shown in FIG. 4.

Then, the determined distance (d2) between the LED elements 13 is compared with the resolution pitch (d1 (μm): theoretical value) of the LED printhead and adjustment of the light amount ends if it is less than a set error (T).

The corrected value of the light amount is calculated so that the light amount of the LED elements 13 of at least one side of the joints of the LED chips 11 is raised when the determined distance (d2) between the LED elements 13 is longer than the resolution pitch (d1) and the light amount of the LED elements 13 of at least one side of the joints of the LED chips 11 is lowered when the distance between LED chips 11 is shorter than the resolution pitch (d1) (Step 4).

In the example of the present embodiment, when the change in the light amount of the LED elements 13 whose light amount is raised and lowered is represented as P (%), P was equal to d2−d1. Thus, in the case of the beam profiles shown in FIG. 4, the invention was configured so that the total light amount of the LED element 13*b* and the LED element 13*c* was raised (or lowered).

Besides, the raising and lowering of the light amount of the light-emitting elements is conducted with at least one of the current flowing to the light-emitting elements and the drive time of the light-emitting elements.

This corrected value is written to the EEPROM 21 (Step 5) to conclude adjustment of the light amount.

According to this adjustment method, the following effects can be obtained.

(1) By using the beam profiles of the plural LED elements 13 including the joints of the LED chips 13, correction that is more precise in comparison to a case where correction is conducted with the pitch of the joints of the LED chips 11 can be conducted.

(2) By determining the distance (d2) between the LED elements 13 at the joints of the LED chips 11 from the distance between peaks of the beam profiles, comparing the determined distance (d2) between the LED elements 13 with the resolution pitch (d1) of the LED printhead, raising the light amount of the LED elements 13 of at least one side of the joints of the LED chips 11 when the determined distance between the LED elements 13 is longer than the resolution pitch, and lowering the light amount of the LED elements 13 of at least one side of the joints of the LED chips 11 when the distance between the LED chips 11 is shorter than the resolution pitch, more precise correction can be conducted because correction is conducted in accordance with the actual pitch of the plural LED elements 13 including the joints of the LED chips 11 in comparison to correction where the current supplied to the LED elements 13 at the joints of the LED chips 11 is uniformly increased to be more than the current supplied to the other LED elements 13.

(3) Because d2−d1=P when the determined distance between the LED elements 13 is represented as d2 (μm), the resolution pitch is represented as d1 (μm) and the change in the light amount of the LED elements 13 whose light amount is raised and lowered is represented as P (%), the correction resolution can be made small and white stripes and black stripes do not occur regardless of the printing pattern.

Figure 5:
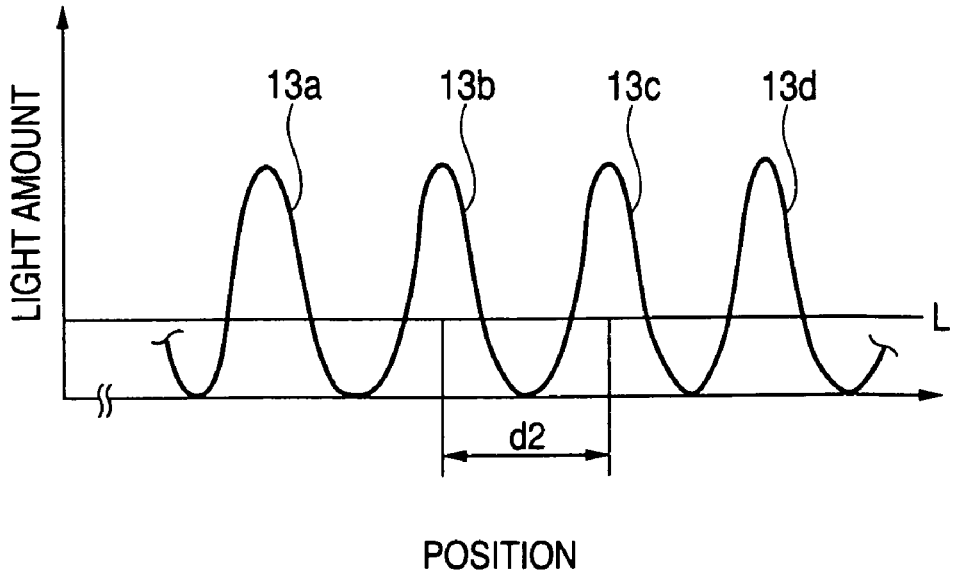
FIG. 5 is a graph describing another method of determining the distance between LED elements at joints of LED chips from beam profiles.
Figure 6:
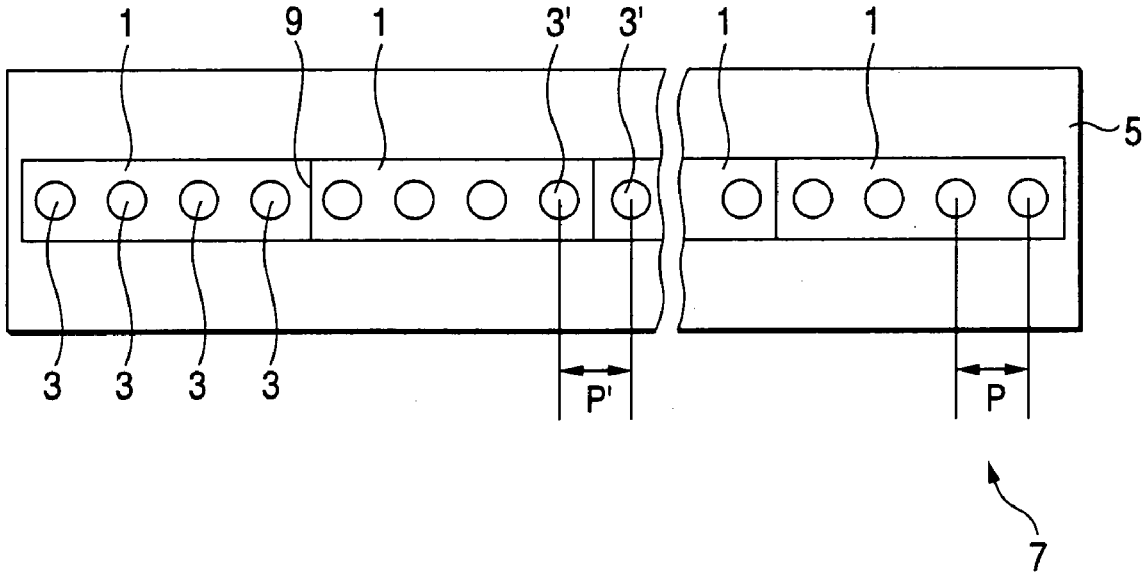
FIG. 6 is a diagram showing the configuration of an LED printhead.

It should be noted that the present invention is not limited to the example of the above-described embodiment. Although the distance (d2 (μm)) between the LED elements 13 at the joints of the LED chips 11 was determined from the beam profiles of the LED elements 13 including the joints of the LED chips 11 in Step 2 in the example of the above-described embodiment, as shown in FIG. 5 the beam profiles may be sliced at a predetermined level (L) and the distance (d2) between the LED elements at the joints of the LED chips may be determined from the distance between median points of the sliced plane.

As stated above, according to a first aspect of the invention, by using the beam profiles of the plural light-emitting elements including the joints of the light-emitting chips, correction that is more precise in comparison with a case where correction is conducted with the pitch of the joints of the light-emitting chips can be conducted.

Also, by determining the distance between the light-emitting elements at the joints of the light-emitting chips from the distance between peaks of the beam profiles, comparing the determined distance between the light-emitting elements with the resolution pitch of the printhead, raising the light amount of the light-emitting elements of at least one side of the joints of the light-emitting chips when the determined distance between the light-emitting elements is longer than the resolution pitch, and lowering the light amount of the light-emitting elements of at least one side of the joints of the light-emitting chips when the distance between the light-emitting chips is shorter than the resolution pitch, more precise correction can be conducted because correction is conducted in accordance with the actual pitch of the plural light-emitting elements including the joints of the light-emitting chips in comparison to correction where the current supplied to the light-emitting elements at the joints of the light-emitting chips is uniformly increased to be more than the current supplied to the other light-emitting elements.

According to a second aspect of the invention, by using the beam profiles of the plural light-emitting elements including the joints of the light-emitting chips, correction that is more precise in comparison with a case where correction is conducted with the pitch of the joints of the light-emitting chips can be conducted.

Also, by slicing the beam profiles at a predetermined level and determining the distance between the light-emitting elements at the joints of the light-emitting chips from the distance between median points of the sliced plane, comparing the determined distance between the light-emitting elements with the resolution pitch of the printhead, raising the light amount of the light-emitting elements of at least one side of the joints of the light-emitting chips when the determined distance between the light-emitting elements is longer than the resolution pitch, and lowering the light amount of the light-emitting elements of at least one side of the joints of the light-emitting chips when the distance between the light-emitting chips is shorter than the resolution pitch, more precise correction can be conducted because correction is conducted in accordance with the actual pitch of the plural light-emitting elements including the joints of the light-emitting chips in comparison to correction where the current supplied to the light-emitting elements at the joints of the light-emitting chips is uniformly increased to be more than the current supplied to the other light-emitting elements.

According to a third aspect of the invention, because d2−d1=P when the determined distance between the light-emitting elements is represented as d2 (μm), the resolution pitch is represented as d1 (μm) and the change in the light amount of the light-emitting elements whose light amount is raised and lowered is represented as P (%), the correction resolution can be made small and white stripes and black stripes do not occur regardless of the printing pattern.

What is claimed is:

1. A method of correcting the light amount of a printhead in which plural light-emitting chips, in which plural light-emitting elements are formed in a row, are disposed in a row, the method comprising:

determining beam profiles of the plural light-emitting elements including a joint of the light-emitting chips;

slicing the beam profiles at a predetermined level and determining distance between the light-emitting elements at the joint of the light-emitting chips from distance between median points of the sliced plane;

comparing the determined distance between the light-emitting elements with resolution pitch of the light-emitting printhead;

raising light amount of the light-emitting elements of at least one side of the joint of the light-emitting chips when the determined distance between the light-emitting elements is longer than the resolution pitch; and lowering light amount of the light-emitting elements of at least one side of the joint of the light-emitting chips when the distance between the light-emitting chips is shorter than the resolution pitch.

2. The method of correcting the light amount of a printhead of claim 1, wherein when the determined distance between the light-emitting elements is represented as d2 (μm), the resolution pitch is represented as d1 (μm) and the change in the light amount of the light-emitting elements whose light amount is raised and lowered is represented as P (%), d2−d1=P.

3. A printing apparatus comprising:

a printhead in which plural light-emitting chips, in which plural light-emitting elements are formed in a row, are disposed in a row;

a controller that determines beam profiles of the plural light-emitting elements including light-emitting elements at a joint of the light-emitting chips, and determines distance between the light-emitting elements at the joint of the light-emitting chips according to distance between median points of sliced plane made by slicing the beam profiles at a predetermined level; and a driver that drives the plural light-emitting elements based on the distance determined by the controller and resolution pitch of the light-emitting printhead, light amount of at least one of two light-emitting elements which neighbor at the joint of the light-emitting chips being different from light amount of light-emitting elements which neighbor the two light-emitting elements.

4. A printhead comprising:

a light-emitting portion in which plural light-emitting chips, in which plural light-emitting elements are formed in a row, are disposed in a row;

a controller that determines beam profiles of the plural light-emitting elements including light-emitting elements at a joint of the light-emitting chips, and determines distance between the light-emitting elements at the joint of the light-emitting chips according to distance between median points of sliced plane made by slicing the beam profiles at a predetermined level; and a driver that drives the plural light-emitting elements based on the distance determined by the controller and resolution pitch of the light-emitting portion, light amount of at least one of two light-emitting elements which neighbor at the joint of the light-emitting chips being different from light amount of light-emitting elements which neighbor the two light-emitting elements.

* * * * *